United States Patent [19]

Kaeser

[11] Patent Number: 4,892,090

[45] Date of Patent: Jan. 9, 1990

[54] GUIDED RUNNING BELT OVER MASSAGE ROLLERS HAVING VARYING PROJECTIONS

[76] Inventor: Ernst Kaeser, Hauptstrasse 8, CH-4654 Lostorf, Switzerland

[21] Appl. No.: 221,799

[22] Filed: Jul. 20, 1988

[30] Foreign Application Priority Data

Jan. 27, 1988 [EP] European Pat. Off. ..... 88101127.4

[51] Int. Cl.[4] ..... A61H 11/00; A61H 15/00

[52] U.S. Cl. ..... 128/58; 128/57

[58] Field of Search ..... 128/58, 57, 25 B; 272/69

[56] References Cited

U.S. PATENT DOCUMENTS

| | | | |
|---|---|---|---|
| 759,296 | 5/1904 | Morairty | 272/69 |
| 767,221 | 8/1904 | Hagen | 272/69 |
| 1,211,765 | 1/1917 | Schmidt | 272/69 |
| 1,569,467 | 1/1926 | Edwards | 128/57 |
| 1,722,866 | 7/1929 | Snyder | 128/57 |
| 2,230,890 | 2/1941 | McClenathen | 128/57 |
| 2,512,904 | 6/1950 | Strelecky | 128/25 B |
| 3,205,888 | 9/1965 | Stroop | 272/69 |
| 3,415,514 | 12/1968 | Weihs | 128/57 |
| 3,642,279 | 2/1972 | Cutter | 272/69 |
| 4,066,257 | 1/1978 | Moller | 272/69 |
| 4,113,246 | 9/1978 | Gibbs | 128/57 |
| 4,165,737 | 8/1979 | Chapa | 128/58 |
| 4,205,663 | 6/1980 | Fujiwara | 128/57 |
| 4,413,821 | 11/1983 | Centafanti | 272/69 |
| 4,579,335 | 4/1986 | Centafanti | 272/69 |

FOREIGN PATENT DOCUMENTS

| | | | |
|---|---|---|---|
| 224120 | 3/1959 | Australia | 272/69 |
| 1044355 | 11/1958 | Fed. Rep. of Germany . | |
| 1478027 | 7/1969 | Fed. Rep. of Germany . | |
| 2530607 | 10/1976 | Fed. Rep. of Germany | 128/57 |
| 2703965 | 5/1978 | Fed. Rep. of Germany | 128/57 |
| 2831132 | 1/1979 | Fed. Rep. of Germany . | |
| 273812 | 2/1951 | Switzerland | 128/57 |
| 627641 | 1/1982 | Switzerland . | |
| 1017330 | 5/1983 | U.S.S.R. | 128/57 |

*Primary Examiner*—Edgar S. Burr
*Assistant Examiner*—Tonya Lamb
*Attorney, Agent, or Firm*—Foley & Lardner, Schwartz, Jeffery, Schwaab, Mack, Blumenthal & Evans

[57] ABSTRACT

The invention relates to a massage appliance for foot reflex-zone massage, with several massage rollers which are arranged axis-parallel and are mounted so as to be freely rotatable in a frame and the approximately cylindrical outer surface of which has elevations of differing radial height arranged distributed over the roller length and the roller circumference. In order to improve the massage effect, the roller elevations are made bead-like and respectively extend annularly round at least a part circumference of the outer surface. An endless running belt is guided round the massage rollers. A motor drive is provided for the running belt, the running direction being transverse relative to the axes of rotation of the massage rollers.

12 Claims, 2 Drawing Sheets

GUIDED RUNNING BELT OVER MASSAGE ROLLERS HAVING VARYING PROJECTIONS

BACKGROUND OF THE INVENTION

The invention relates to a massage appliance for foot reflex-zone massage, with several massage rollers which are arranged transversely and are mounted so as to be freely rotatable in a frame and the approximately cylindrical outer surface of which has elevations of differing radial height distributed over the roller length and the roller circumference.

An embodiment of this type can be taken from DE-A-2,831,132. The massage-roller elevations disclosed here are each made stud-like with a rounded head and extend in each case in the radial direction, the studs, being arranged respectively in rows on the cylindrical outer surface of the massage rollers. The studs provided in the middle region of a massage roller can have a larger radial height than the studs arranged in the lateral edge regions of the roller. The studs themselves can be made of rubber or an elastic plastic, but also of hard or rigid plastic. The massage rollers are arranged at different heights within the frame, in such a way that the middle roller is the highest, so that a line connecting the heads of the respective upwardly projecting studs of the massage rollers from the first roller to the last forms a slightly upwardly convex curve. The massage rollers are not covered at the top, so that the person using the appliance stands with the soles of his feet directly on the stud-like projections of the massage rollers.

By a foot reflex zone is meant a part of the foot which is limited by a portion of the sole and which is joined to the same organ by means of sinews. Various reflex zones are accessible for massage on the sole of the foot, the dimensions of the individual reflex zones being relatively small. For an effective foot reflex-zone massage, it is necessary for each individual reflex zone to be thoroughly massaged with great vigor. For this purpose, in the previously known appliance described above, it is necessary to stand with both feet on the appliance resting on the floor and move both feet alternately forwards and backwards. The massage rollers thereby rotate under the soles of the feet, and the stud-like elevations massage the foot reflex zones. A comparable appliance is also shown in CH-A-627,641.

There are also known training appliances for walking practice and running training which are also referred to as orthopedic appliances for strengthening the muscles and ligaments of the foot and for achieving a natural static posture of the spinal column (DE-A-1,478,027, DE-B-1,044,355, U.S. Pat. No. 3,642,279 and U.S. Pat. No. 1,211,765). Thus, for example, DE-A-1,478,027 describes a training appliance with a moved running belt in the manner of an endless conveyor belt guided by two running rollers, the speed of which is continuously adjustable within specific limits. Here, the upper side of the running belt is supported by bearing surfaces and supporting rollers which project upwards above the bearing surfaces and which are made smoothsurfaced. At the same time, the supporting rollers can be subdivided and the respective parts connected to one another in an articulated manner. Arranged at one front end of the training appliance is a holding bar, on which a control element for the running speed of the drive motor and an emergency switch are provided. Appliances of this type provide walking practice for persons who have difficulty in walking and who are convalescing and, on the other hand, are suitable for running training for athletes or for balancing exercises.

In this known embodiment, it is considered a disadvantage that the user of the appliance stands with the soles of his feet directly on the stud-like elevations of the massage rollers and has to drive these as a result of his own foot movements. Because the heads of the studs forming the roller elevations exert pressure on the soles of the feet at certain points, only a slight massage effect can be generated; moreover, such an appliance is not very comfortable to use.

SUMMARY OF THE INVENTION

The object on which the invention is based is, therefore, to improve a massage appliance in terms of its efficiency and its practical comfort.

Another object of the invention is to provide such a massage appliance with several massage rollers arranged transversely of the running direction of the appliance.

A further object of the invention is to mount the rollers so as to be freely rotatable in a frame wherein the approximately cylindrical outer surface of the rollers have elevations of differing radical height.

According to the invention, these objects are achieved, by means of the following additional features:

(a) the roller elevations are made bead-like and respectively extend annularly round at least a part circumference of the outer surface;

(b) an endless running belt is guided round the massage rollers; and (c) a motor drive is provided for the running belt, the running direction being transverse relative to the axes of rotation of the massage rollers.

BRIEF DESCRIPTION OF THE DRAWINGS

The drawings show some embodiments of the invention which serve as examples. In the drawings.

DETAILED DESCRIPTION OF THE PREFERRED EMBODIMENTS

Figure 1A:
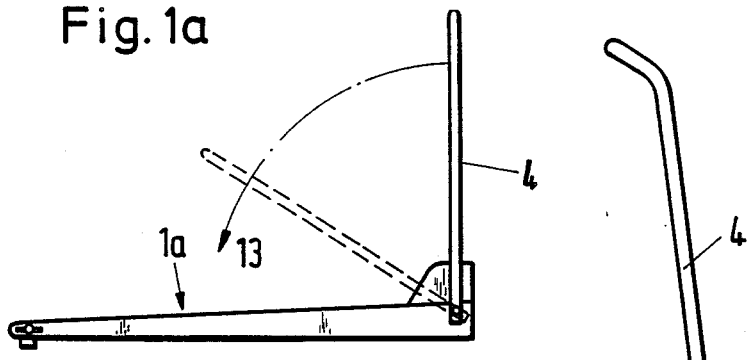
FIG. 1*a* shows a side view of a massage appliance.
Figure 1B:
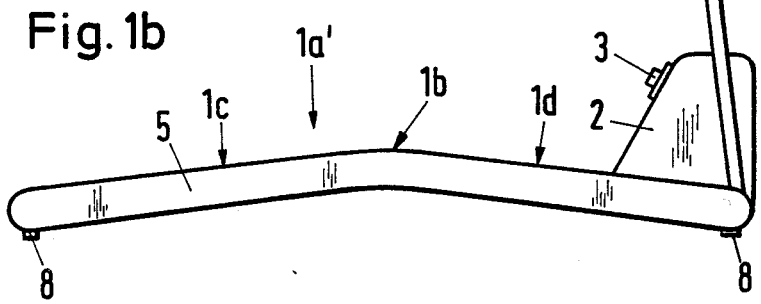
FIG. 1*b* shows a modified embodiment in a representation according to that of FIG. 1*a;*
Figure 2:
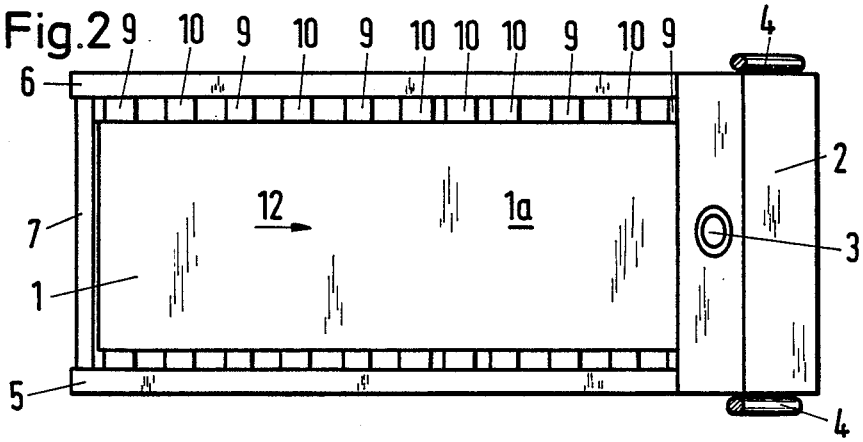
FIG. 2 shows a plan view of the embodiment according to FIG. 1*b;*

The massage appliance illustrated in FIGS. 1 and 2 comprises essentially a rigid frame 5, 6, 7, in which supporting rollers 9, with massage rollers 10 respectively arranged between them, are mounted so as to be freely rotatable. Guided round the supporting rollers 9 and the massage rollers 10 is an endless running belt 1 which can be driven from an electric motor (not shown in detail) accommodated in a drive box 2 which, as seen in the running direction 12 of the running belt 1, is located at the front end of the said frame 5, 6, 7 and which has a foot switch 3 for switching off the drive. Furthermore, articulated on the said front end of the frame 5, 6, 7 is a holding bar 4 which is pivotable into the plane of the running belt 1 (see the arrow 13 and the dot-and-dash representation in FIG. 1*a*) and which can be locked in its working position represented by unbroken lines in FIGS. 1*a* and 1*b*. The frame 5, 6, 7 stands on non-slip feet 8.

Figure 3:
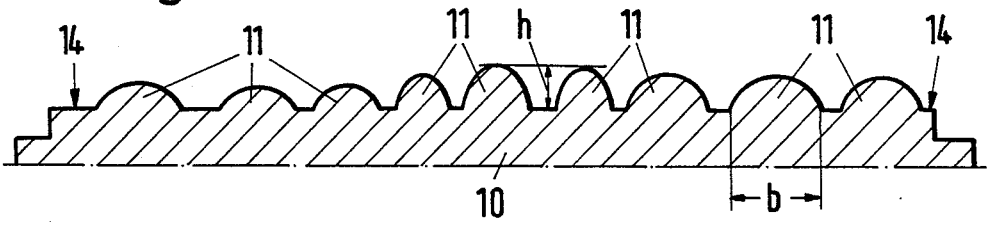
FIG. 3 shows, on an enlarged scale, a longitudinal section through one half of a massage roller.
Figure 4:
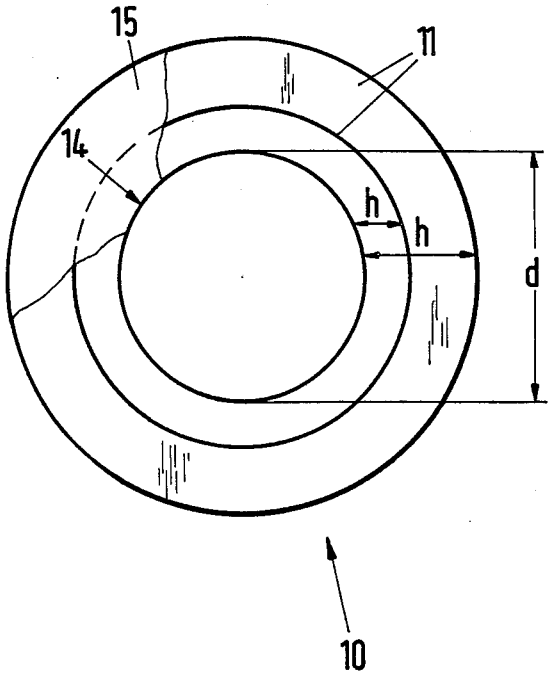
FIG. 4 shows a cross-section through a massage roller according to FIG. 3.

According to FIGS. 3 and 4, a massage roller 10 has a cylindrical outer surface 14 of a diameter d. This outer surface 14 is equipped with bead-like roller elevations 11 which respectively extend annularly over at least a part circumference of the outer surface 14. The roller elevations 11 are arranged distributed over the length of the massage roller 10 axially spaced from each other and, as shown in FIG. 3, have a differing radial height h and a differing width b. At the same time, the roller elevations 11 of greatest radial height h and of smallest width b are provided in the middle roller region. In contrast, the roller elevations 11 in the two outer roller regions are made lower and wider.

FIG. 4 shows that a roller elevation resembling an annular bead can also have a transverse indentation 15 which extends in the radial direction up to the outer surface 14. The indentation 15 forms an interruption within one elevation 11 so that the elevation 11 does not form a closed ring.

In the embodiment according to FIG. 1*a*, running surface la of the running belt is substantially planar as seen in the running direction 12. In the embodiment according to FIG. 1*b*, running surface 1*a*' includes an upwardly curved arc 1*b* which is disposed between and merges into adjacent planar portions 1*c*, 1*d*.

Each supporting roller 9, not shown in detail in the drawing, is made smooth-cylindrical and has a diameter which corresponds to the diameter d of the cylindrical outer surface 14 of the massage roller 10.

The frame 5, 6, 7 can be composed, for example, of aluminum die-cast parts, in order to keep the machining costs and the total weight low. When the holding bar 4 is swung down, the appliance can be stored in a space-saving way, for example in a closet.

The holding bar, in its locked working position, enables a person running on the running belt 1 to keep a firm hold. In addition to the foot switch 3 provided on the drive box 2, there can also be a further stop switch on the holding bar 4. The electric motor accommodated in the drive box 2 is preferably of variable speed, so that the running speed of the running belt 1 can be continuously adjusted directly on the motor or on the holding bar 4 by means of an adjusting device (not shown), and in principle this would also be possible by means of a continuously variable gear.

If the running belt has an arcuate form according to FIG. 1*b*, it is advantageous if several massage rollers 10 are arranged directly next to one another in the vertex region of the arc, so that a region of especially intensive massage is obtained there.

The massage rollers 10 can, for example, be lathe-turned economically from hardwood by cutting in the copying process, but can also be molded from a suitable plastic (with or without a metallic core).

The design in the manner of an annular bead of the individual roller elevations, the shape of which makes it possible to provide a motor-driven running belt, is therefore essential to the invention. The elevations are rounded so as not to ruin the underside of the belt and to provide support for the running surface. Because of this, there is a kneading and pummeling of. the sole of the foot and consequently a substantially more efficient massage than with the known massage appliances. Both efficiency and comfort are enhanced as a result of the running belt known hitherto only in training appliances for walking and running practice. The massage appliance according to the invention can, at the same time, also be used for strengthening the circulation and the respiratory organs. The roller elevations designed to resemble annular beads can have differing radii and/or arcs and surfaces, but it always remains possible for the running belt to be supported on the said roller elevations which cause an intensive massage action in the respective supporting regions. The running belt serves at the same time as a tread surface.

In order to avoid excessive massaging of the foot reflex zones, it is expedient if a smooth-cylindrical freely rotatable supporting roller for supporting the running belt is arranged respectively at least between some of the massage rollers.

It is advantageous if the bead-like roller elevations arranged axially spaced from each other over the length of a massage roller have a differing width. In addition, it can be advantageous if roller elevations of differing height and/or width succeed one another respectively, as seen in the direction 12. A kind of knobbed plate is thus formed underneath the running belt. During the time from when the foot is put down, to when the foot is lifted, the sole of the foot is drawn by the running belt over the irregularly arranged elevations of the massage rollers, with the result that virtually all the reflex zones present on the soles of the feet are massaged alternately by means of intensive kneading and pummeling actions. This leads to an increased flow of blood through the organs connected to the respective reflex zones, and consequently to an increase in mental and physical well-being.

Massage regions of differing intensity can be obtained if different configurations are used for the roller elevations. This can also be achieved by the use of massage rollers which are asymmetric over the length and in which the elevations provided on one axial half of the massage roller differ from those on the other axial half. Appropriate massage zones can be formed as a result of a laterally transposed arrangement of successive massage rollers of this type. This can also be achieved if, as seen in the direction 12, the roller elevations of one massage roller are arranged respectively offset relative to the roller elevations of the following massage roller. As a result of this offset arrangement, for example, as seen in the direction 12, a clear gap between two elevations can be obtained from the roller elevation of one roller to that of the adjacent roller.

In order to match the curved form of the sole of the foot, it can also be advantageous if the roller elevations of each massage roller have the greatest radial height in the middle roller region, and if the roller elevations of each massage roller are made wider in the two outer roller regions than in the middle roller region.

The intensity of the massage action can be increased if one or more of the roller elevations have traverse indentations which extend in the radial direction at most up to the outer surface.

The upper side, constituting the tread or running surface, of the running belt can extend rectilinearly, specifically horizontally or with a slight rise. However, likewise in order to match the form of the sole of the foot, it can also be advantageous if at least the upper side, constituting the running surface of the running belt forms an upwardly curved arc, as seen in the direction 12. This arc can be disposed between and merge into adjacent planar portions. In order, with this arcuate guidance of the running belt, to achieve a specially intensive foot reflex-zone massage in the vertex region of the arc, it can be advantageous if no supporting rollers, but only massage rollers arranged close to one another are provided in the vertex region.

Furthermore, the massage effect can be influenced if the user of the appliance stands on the running belt barefoot or uses shoes with varyingly firm and/or thick soles.

As seen in the direction 12, there can be articulated on the front end of the frame, a holding bar which is pivotable into the plane of the running belt for the transport or storage of the appliance, but which can be locked in its working position when the appliance is in use. The efficiency and comfort of the appliance according to the invention can be further increased if an electric motor forming the drive for the running belt is arranged in a drive box which, as seen in the direction 12, is located at the front end of the frame and which has a foot switch for switching off the drive.

What is claimed is:

1. A massage appliance for foot reflex-zone massage, comprising:

a frame assembly having a running direction;

a plurality of elongated massage rollers arranged transversely of said running direction and mounted so as to be freely rotatable in said frame; each of said rollers having a cylindrical outer surface;

each of said massage rollers having a plurality of rounded ring shaped roller elevations extending radially therefrom;

said roller elevations being disposed about at least a part of the circumference of the cylinder outer surface of said massage rollers, said elevations varying in radial height and in axial width;

said roller elevations of one massage roller being offset transversely relative to the roller elevations of adjacent massage rollers, an endless running belt guided around the massage rollers to form a running surface; and means for driving the running belt in the running direction transverse to the axes of rotation of the massage rollers.

2. The massage appliance as claimed in claim 1, wherein adjacent rounded roller elevations are axially spaced from each other over the massage roller transversely of the running direction.

3. The massage appliance as claimed in claim 1, wherein roller elevations which succeed one another in the running direction having differing radial heights.

4. The massage appliance as claimed in claim 1, wherein at least one of the roller elevations has at least one indentation disposed therein, said indentation being transverse of said running direction.

5. The massage appliance as claimed in claim 1, wherein the running surface of the running belt is substantially planar.

6. The massage appliance as claimed in claim 1, wherein the running surface comprises an arcuate surface disposed between two spaced apart planar surfaces.

7. The massage appliance as claimed in claim 1, including:

a holding bar which is pivotable substantially to the plane of the running belt and which can be locked in a working position.

8. The massage appliance as claimed in claim 1, wherein the means for driving the running belt is in a drive box which has a foot switch for switching off the drive.

9. The massage appliance as claimed in claim 1, further comprising a plurality of cylindrical freely rotatable supporting rollers for supporting the running belt arranged transversely of said running direction adjacent corresponding massage rollers.

10. The massage appliance as claimed in claim 9, wherein the diameter of the supporting rollers corresponds to the diameter of the cylindrical outer surface of the corresponding massage rollers.

11. The massage appliance as claimed in claim 1, wherein the roller elevations of each massage roller have the greatest radial height and the least axial width in a middle portion of the roller.

12. The massage appliance as claimed in claim 11, wherein the roller elevations of each massage roller have the least radial height and the greatest axial width adjacent opposite end portions of the roller.

* * * * *